United States Patent [19]

Faffart

[11] Patent Number: 5,012,214

[45] Date of Patent: Apr. 30, 1991

[54] LOCK MECHANISM FOR A LIMITING CONTACT MAKER

[75] Inventor: André Faffart, Nanterre, France

[73] Assignee: Telemecanique, France

[21] Appl. No.: 437,070

[22] Filed: Nov. 16, 1989

[30] Foreign Application Priority Data

Nov. 17, 1988 [FR] France ..... 88 14919

[51] Int. Cl.[5] ..... H01H 75/00

[52] U.S. Cl. ..... 335/6; 334/185

[58] Field of Search ..... 335/6, 16, 38, 41, 145, 335/196, 185-190; 361/102, 115

[56] References Cited

U.S. PATENT DOCUMENTS 4,495,538 1/1985 Thomas ..... 335/6

*Primary Examiner*—Leo P. Picard
*Assistant Examiner*—Lincoln Donovan
*Attorney, Agent, or Firm*—William A. Drucker

[57] ABSTRACT

A locking mechanism for a limiting contact maker is divulged comprising two levers which act respectively on two pusher blocks actuating the switches of a change-over contact maker. Each of these levers, articulated about a fixed shaft, comprises a roller applied to the profile of a rotary cam by a spring. This cam may pass from a locked automatic operational position in which it allows the switches to close by maintaining the levers away from the pusher blocks, to a tripped position in which the lever acts on the pusher blocks for holding the switches in the open position.

13 Claims, 4 Drawing Sheets

LOCK MECHANISM FOR A LIMITING CONTACT MAKER

BACKGROUND OF THE INVENTION

The present invention relates to a lock mechanism for a limiting contact maker, of the kind comprising at least one set of switches which can be closed and opened by a control electromagnet, which forms its contact making function, or else opened only by a device which, associated with an overload detector, provides rapid opening corresponding to the limiting function.

The limiting function has priority over the contact making function, which means that in the case of closure on a short circuit, the process of opening the switches must take place as rapidly as possible. For this, the control for opening the switches is provided by an appropriate mechanism, cut-off of the power supply to the electromagnet only taking place so as to confirm the cutoff.

SUMMARY OF THE INVENTION

An object of the invention is to provide a mechanism of this kind which is extremely reliable and with high speed operation, while being relatively inexpensive.

A further object of the invention is such a mechanism which may also be associated with a change-over limiting contact maker formed by two limiting contact makers mounted side by side.

An additional object is a mechanism of this type which may assume three stable positions, namely "stop", "go", "tripped" and a transitory resetting position.

According to the invention, this aim and these objects as well as others which will appear subsequently, are attained through a mechanism of said type comprising at least one lever which acts on at least one pusher block for actuating the switches and which is articulated about a fixed shaft, this lever comprising a bearing surface, formed preferably by a roller, applied on the profile of a cam by resilient means, means being provided for causing this cam to pass from a locked automatic operational position where it holds the lever away from the pusher block, thus allowing the switches to close, towards a tripped position in which the lever acts on the pusher block so as to hold the switches in the open position.

It should be noted that in the locked position the mobile contacts of the switches may be brought into a normally closed position by means of return springs and actuated through the action on the pusher block of an electromagnet providing the contact making function.

In an advantageous embodiment of the invention, the mechanism comprises two levers acting on at least one pusher block, these two levers being articulated about two respective shafts and each having a bearing surface urged on to the profile of a cam by resilient means. Means are then provided for causing this cam to pass from a locked automatic operational position in which the width of the cam in line with the bearing surfaces is maximum, towards a tripped position in which this width is minimum and in which the levers act on the pusher block for holding the switches open.

It will be understood that, when the cam of this device is unlocked, which is free to rotate about its shaft which is perpendicular thereto, the rollers which bear thereon grip it with their resilient return means and bring it towards the position of smallest width. The bearing surfaces which bear thereon are simultaneously brought together while causing the levers to rock, whose free ends push the pusher block in the opening direction of the switches.

In an advantageous embodiment of this mechanism, each of the above specified levers has the form of a Z, it is articulated in the vicinity of a bend of the Z, its free end situated on the same side as its articulation carries a corresponding roller and its other free end is situated opposite the corresponding pusher block. With this arrangement, an energetic and well geared down action is obtained on the pusher blocks and their switches.

Preferably, the cam of the mechanism of the invention has the form of an S, and its rollers bear on its external contour.

Advantageously, this cam is mounted free on a perpendicular shaft which is fast with a control knob at one end, which has locking and control cams and which is returned to the "stop" position by a helical spring which surrounds it. It is by rotating this knob that the mechanism is caused to pass to the "stop", "automatic" and "reset" positions.

Furthermore, this knob may be fast with a finger capable of urging the cam towards its locked position, in which position it engages with a trigger and is locked against rotation. The cam may then be released by actuating this trigger by means of one or more fault detection relays.

Advantageously, the central shaft of the above specified device carries a control cam whose periphery has a notch into which, under the action of a resilient means, a finger may penetrate which is mounted on a lever which, in this position, causes closure of a switch mounted in series with the circuit energizing the electromagnets providing the "contact maker" function. This corresponds to the "automatic operational " position of the device.

In an advantageous embodiment, the mechanism of the invention comprises a dog mounted for pivoting on a fixed shaft against a spring and which may be locked by two triggers each of which may be unlocked by a fault detection relay. One of these triggers may be the one which also locks the main above specified S shaped cam and which is controlled by a fault detection relay, whereas the other is controlled by another fault detection relay, a connection existing between these two triggers or not.

When the mechanism of the invention is to operate as a change-over limiting contact maker, the above specified levers act simultaneously on the pusher blocks corresponding to the assembly of switches to be actuated.

BRIEF DESCRIPTION OF THE DRAWINGS

The following description which has no limitative character will better show how the present invention may be put into practice. It should be read in conjunction with the following drawings in which.

DESCRIPTION OF THE PREFERRED EMBODIMENTS

Figure 1:
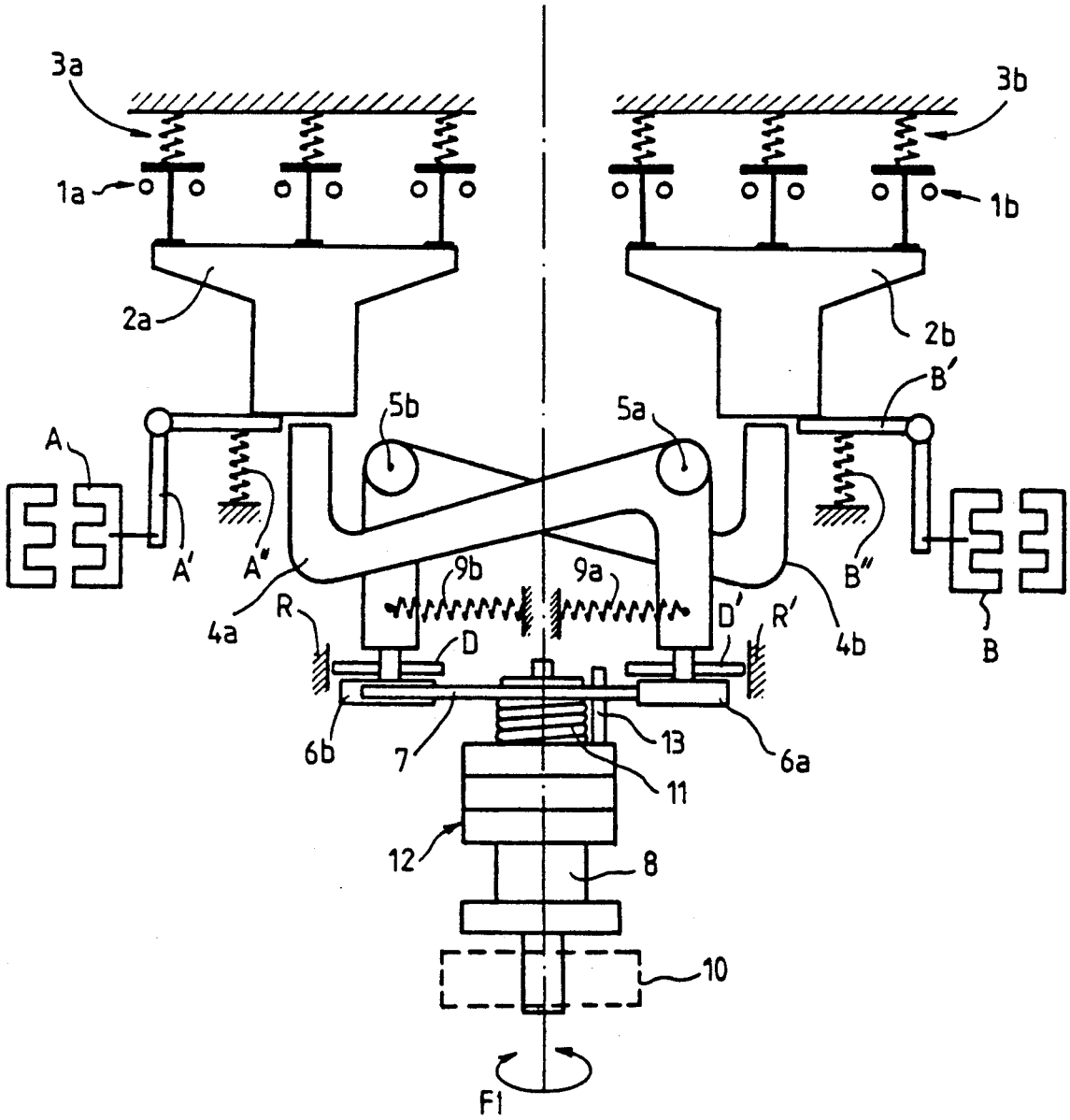
FIG. 1 shows a schematic side view of the lock mechanism of the present invention, associated with two contact makers.

As can be seen in FIG. 1, the mechanism of the invention serves for opening and closing two groups of three switches 1*a* and 1*b*, the mobile contacts of each group being actuated simultaneously by a pusher block 2*a* or 2*b*, respectively. This latter pushes the three corresponding contacts in the opening direction shown in the Figure, against springs 3*a* or 3*b* which tend to return their groups of respective mobile contacts 1*a* and 1*b* in the closing direction.

The members associated with the two pusher blocks 2*a* and 2*b* are symmetrical and, for the sake of simplicity, they will be designated by the same reference followed or not by the letter a or b respectively.

Each pusher block 2 may be pushed or released by an electromagnet A or B through a lever A′ or B′ and against a spring A″ or B″, the switches 1 being closed when the corresponding electromagnet is energized.

Each pusher block 2 may be also pushed towards switches 1 by one end of a lever 4. For this, this lever has the form of a recumbent Z and it is articulated about a shaft 5 which is perpendicular to its plane and which is situated in the vicinity of the tip of the Z opposite the pusher concerned. The other end of this lever 4 carries a roller 6 whose shaft extends substantially in the plane of the lever and in the extension of the leg of the Z which carries it. Each of the two rollers 6 bears on a cam 7 which is common thereto, which extends substantially in the plane of rollers 6 and which is mounted freely on a shaft 8 perpendicular to shafts 5. Rollers 6 are applied to the profile of cam 7 by traction springs 9 and are each guided in their movements by a disk D, respectively D′, which rolls freely on a running track R, R′ parallel to the axis of movement of the rollers.

A rotary control knob 10 which may be fixed to the other end of shaft 8 which may thus be rotated as shown by arrow F1 against a helical return spring 11 which surrounds it and which tends to bring it back to the "stop" position. Finally, shaft 8 is fast with a cam 12 having three tracks perpendicular to the shaft and with a finger 13 which is parallel to shaft 8 and which projects in the plane of cam 7.

Reference will now be made to FIGS. 2 to 5 in which can be seen the pusher blocks 2 of switches 1, the Z levers 4 and, this time in an exploded top view, the rollers 6 following the external profile of cam 7. There can also be seen, also in a top view, the tracks 14, 15 and 16 of the three track cam as well as the control knob 10 in its four positions. Shaft 8 which connects this latter to cams 14, 15 and 16 is shown schematically by a vertical chain-dotted line.

The tripping cam 7 has substantially the shape of an S mounted at its centre on shaft 8, so that its width, taken along a fixed line contained in the plane of FIG. 1, may pass from a low value (FIG. 4) in which rollers 6 are close to one another to a higher value (FIGS. 2, 3 to 5) by moving away from each other and causing the legs which carry to the Z levers 4 to pivot outwardly against springs 9. The result is that the opposite leg of the Z moves away from the associated pusher block 2, this latter moves away from the mobile contacts of the switches 1 and the latter close under the effect of springs 3.

It is in this position that the tripping cam 7 may be blocked by a nose-piece of a trigger 17 which engages in a heel 18 formed in the external profile of cam 7. Trigger 17 is articulated on a shaft 19 perpendicular to the plane of cam 7, whereas its nose-piece, pushed towards the latter by a spring 20, may be released from heel 18 by a fault detection relay, not shown, which causes the trigger to rotate in the direction of arrow F2 against spring 20.

It will be readily understood that when the nose-piece of trigger 17 retracts with respect to heel 18 of the cam, the latter rotates in the direction of the smallest width between rollers 6, for the latter are drawn together by springs 9. Cam 7 then assumes the position shown in FIG. 4.

A dog 21 is articulated to a pivot 22 parallel to shaft 8, at a distance therefrom, and against a return spring 23. It comprises a finger 24 which is directed towards shaft 8 and which bears, under the effect of spring 23, on cam 14. The latter comprises successively: a heel 25 against which finger 24 abuts for locking shaft 8 in an angular position corresponding to the "stop" position against the action of spring 11 and a circular portion allowing shaft 8 to rotate through a quarter of a revolution in a clockwise direction from the "stop" position.

Figure 4:
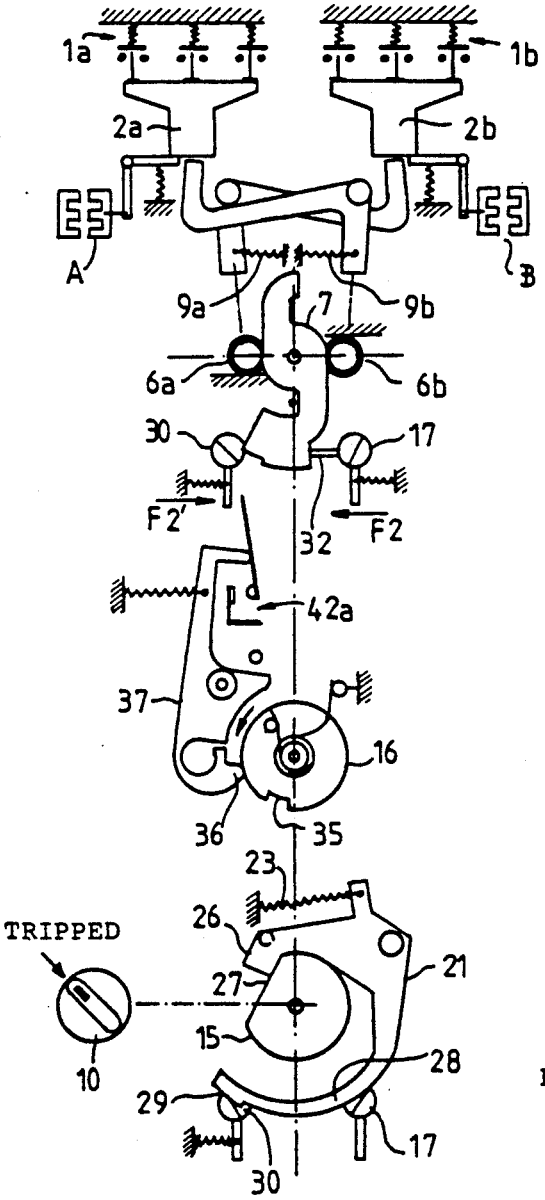
Figure 5:
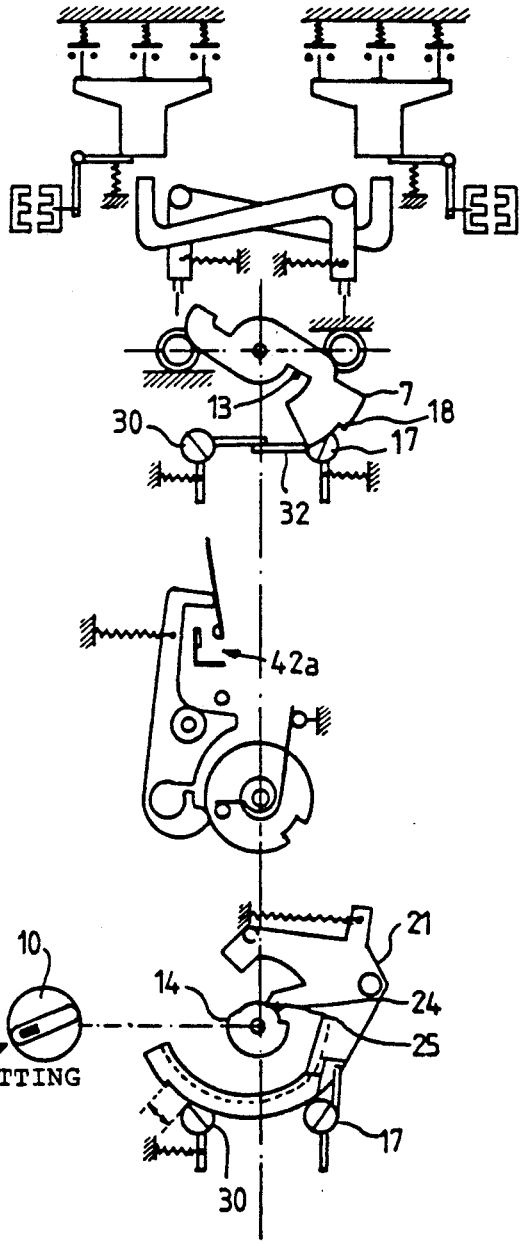

As for cam 15 of shaft 8, shown only in FIG. 4, its rotations in the anti-clockwise direction, and so that of shaft 8 which is fast therewith, are blocked by another finger 26 directed inwardly at the end of dog 21 which engages with a flat 27 formed on this cam 15, in the "tripped" position.

Dog 21 further comprises an arcuate extension 28 which surrounds shaft 8 over about a quarter of a circle, opposite finger 26 and which comprises an external heel 29 engageable with a nose-piece of a second trigger 30. This nose-piece is pushed towards heel 29 by a spring 31 and it may be retracted therefrom by rotation of trigger 30, against this spring 31 under the effect of another fault detection relay not shown which acts in the direction of arrow F2′.

The two triggers 17 and 30 are interlocked in their movement by a lever 32 and a judicial calculation of the lever arms makes it possible to have on each of them a different tripping force adapted to the fault detection relay used, for example, to a thermal or magnetic protection relay or to a voltage missing or voltage emission relay.

Finally, dog 21 further comprises a shoulder 3 in which may penetrate a rod 34 fast with trigger 17.

The third cam 16 fast with shaft 8 comprises, on its periphery, a rectangular notch 35 into which may penetrate a finger 36 which is formed at one end of a lever 37 articulated at 38 and which is pushed towards cam 16 by a spring 39. The other end of lever 37 carries a pusher 40 which acts on the mobile blade 41 of a switch 42 placed in series in the circuits feeding the coils of the electromagnets. When finger 36 is in the normal position on the periphery of cam 16 (FIGS. 2, 4 and 5), pusher 40 bears on the mobile blade 41 and switch 42 is opened, whereas, when this finger 6 penetrates into notch 35 of cam 16 (FIG. 3), pusher 40 releases the blade 41 and switch 42 closes.

In addition, a pin 43 fast with dog 21 may cause lever 37 to rotate in the direction in which finger 36 comes out of notch 35 of cam 16.

Furthermore, and for reasons which will be explained further on, lever 37, in the bend which it forms in line with finger 36, has a recess 44 which is open outwardly on the same side as this finger by a narrow channel 45. A loop spring 46 is housed in recess 44 and both its ends are anchored in the walls of lever 37, so that it tends to close channel 45 again against the resilience of the molded thermoplastic material which forms the lever in question.

The operating mode of this lock mechanism will now be described with reference to FIGS. 2 to 5 which correspond respectively to the "stop", "automatic", "tripped" and "reset" positions of the control knob 10, these positions of the knob being shown in the left hand part of each Figure.

Figure 2:
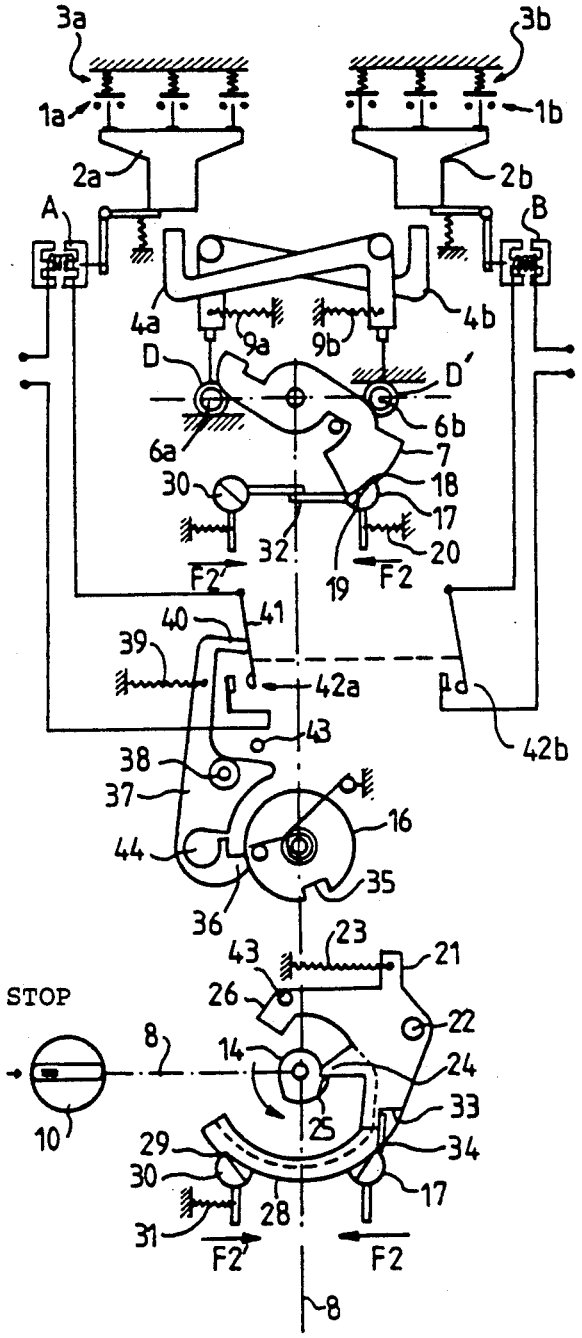
FIGS. 2 to 5 show the mechanism of FIG. 1, certain parts of which have been cut away and shown in a top view, respectively for the four positions of its rotary control knob.

In the "stop" position of FIG. 2, dog 21 is held against rotation in both directions by the nose-pieces of the two triggers 17 and 30. Finger 36 of lever 37 rests on the periphery of cam 16, outside notch 35, so that switch 42 is open and the electromagnets A and B are not energized. The pusher blocks 2 are then caused to bear on switches 1 by levers A' and B' and switches 1 are open. Finally, the Z levers 4 are moved away from the pusher blocks 2 by cam 7, through rollers 6 for cam 7 presents its largest width in line with these latter and is locked by trigger 17 engaged with its heel 18, as well as by the finger 13 fast with the control knob 10.

Figure 3:
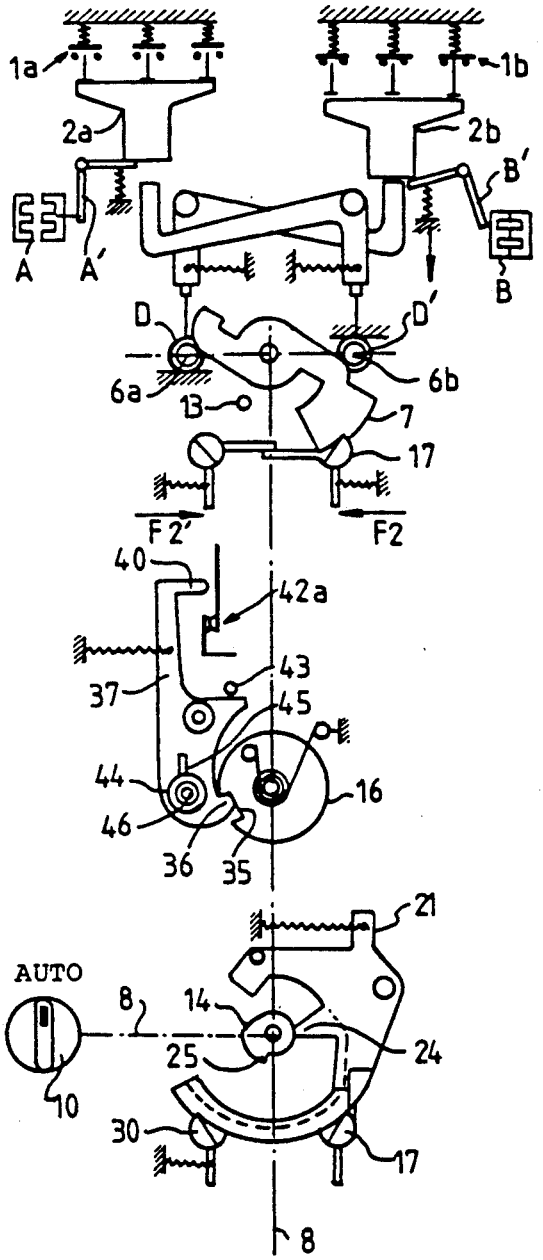

When in the "automatic " position of FIG. 3, in which shaft 8 and cams 14, 15 and 16 which are associated therewith have rotated through 90° in a clockwise direction, dog 21 remains locked by triggers 17 and 30, its finger 24 remaining in contact with the circular position of cam 14. Furthermore, the S shaped cam 7 remains locked by trigger 17 but it is freed from finger 13 fast with knob 10. Rotation of cam 16 has caused finger 36 to penetrate into its notch 35, which has closed switch 42 and caused locking in the "auto" position. The electromagnets A and B are enabled. In this example, the electromagnet B is energized and causes lever B' to rotate against the corresponding spring, so that the pusher block **2*b* has released the mobile contacts of switches 1*b* which close under the effect of springs 3*b***.

It will be further noted that the recess 44 of lever 37 and its loop spring 46 permit correct engagement in the "automatic" position without hindering tripping: when knob 10 is moved to the "stop" position, the notch 35 of cam 16 urges finger 36 downwards which is held in abutment by spring 39 until lever 37 escapes, rocks and opens switch 42.

If, now, one or other of the overload relays is tripped, by exerting a force F2 or F2' on trigger 17 or 30, this releases dog 21 which pivots through about 45° in an anticlockwise direction, under the effect of the return spring 23, until it assumes the position shown in FIG. 4. Concurrently, shaft 8 which is no longer retained by finger 36 which escapes from notch 35, under the effect of spring 11, rotates in an anticlockwise direction until flat 27 of cam 15 is retained by finger 26. Shaft 8 and the knob are then in the "tripped " position.

With trigger 17 thus open, either directly by force F2 or indirectly by force F2' and the transmission lever 32, the S shaped cam 7 may rotate under the effect of rollers 6 on which springs 9 act. The rollers draw nearer together, which causes the free end of Z shaped levers 4 to move towards the pusher blocks 2 and open switches 1. Because finger 36 of lever 37 has come out of notch 35 of cam 16, switch 42 opens, which cuts off the power supply to the electromagnets A and B which also bear on the pusher blocks 2 for opening switches 1.

To reset the mechanism, it is sufficient to rotate the control knob 10 by a little more than 45°, against its helical return spring 11, so that it passes slightly beyond the stop position of FIG. 2. Cam 7, urged by finger 13 fast with knob 10, then engages by its heel 18 on trigger 17, with a slight overtravel, whereas dog 21 resumes its initial position in which it is locked by the two triggers 17 and 30, through the action of heel 25 of cam 14 which urges the finger 24 of the dog. Switch 42 associated with cam 16 remains open and the procedure may begin again.

Figure 6:
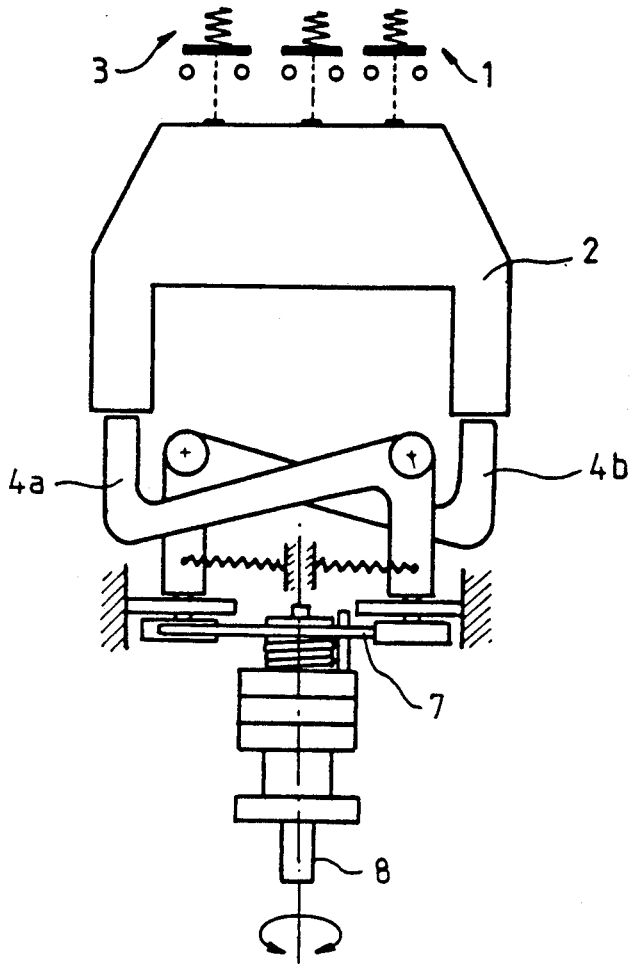
FIG. 6 shows a partial schematic side view of a limiting contact maker of the invention.

The device which has just been described in its application to a change-over limiting contact maker appliance may be applied to a simple limiting contact maker, by replacing the pusher blocks **2*a* and 2*b* of FIG. 1 by a single pusher block 2 shown in FIG. 6 on which the free ends 4*a* and 4*b*** of the two Z levers act.

Figure 7:
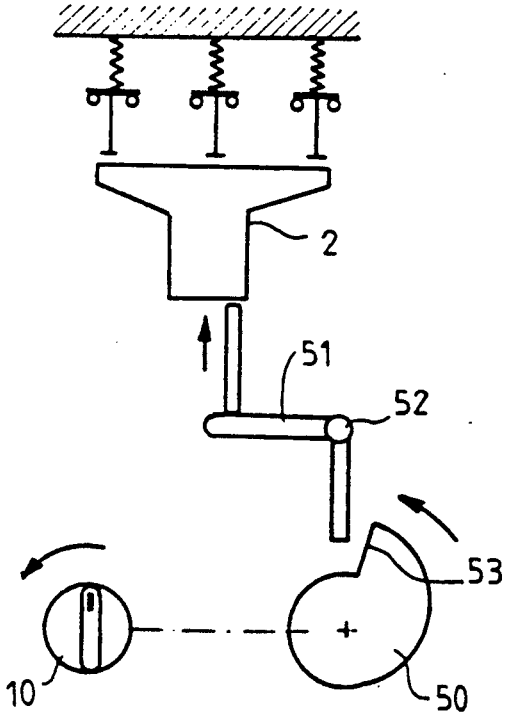
FIG. 7 shows a device for unlocking the mechanism of the invention.

FIG. 7 shows means for carrying out an auxiliary function called "verification of opening positivity" and which use a cam 50 rotated by the control knob 10. Through a lever 51 articulated at 52 and urged by a nose-piece 53 of cam 50, the latter acts on the pusher block(s) 2 independently of the rest of the mechanism, which, through the forced action on knob 10, eliminates foreign bodies or overcomes possible jamming.

What is claimed is:

1. A lock mechanism for a limiting contact maker, of the kind comprising at least one set of power switches which may be closed and opened by a control electromagnet, further comprising two levers acting on at least one pusher block for actuating the switches, these two levers being articulated about two respective shafts and each having a bearing surface formed preferably by a roller urges on a profile of a rotary cam by resilient means, means being provided for causing this cam to pass from a locked automatic operational position in which the width of the cam in line with the bearing surface is maximum and the levers are held away from the pusher, towards a tripped position in which this width is minimum and in which the levers act on the pusher block for holding the switches open.

2. The mechanism as claimed in claim 1, wherein each of said levers has the form of a Z, is articulated in the vicinity of a bend of the Z, its free end situated on the same side as its articulation carrying said roller and its other free end being situated opposite the corresponding pusher block.

3. The mechanism as claimed in claim 1, wherein said cam has the form of an S, and said rollers bear on its external contour.

4. The mechanism as claimed in claim 3, wherein said rollers are each guided in their movement by a disk which rolls freely on a running track parallel to the axis of movement of the rollers.

5. The mechanism as claimed in claim 1, wherein said cam is mounted freely on a shaft, perpendicular to the parallel shafts of two levers, which is fast with a control knob at one end, which has locking and control cams and which is returned to the "stop" position by a helical spring which surrounds it.

6. The mechanism as claimed in claim 5, wherein said control knob is fast with a finger capable of urging said cam towards its locked position, a first trigger then engaging with a heel of this cam which may be released by actuating said first trigger by means of an overload relay placed in series with the power switches.

7. The mechanism as claimed in claim 5, wherein said shaft carries a control cam whose periphery has a notch into which, under the action of a resilient means, a finger may penetrate which is mounted on one end of a lever whose other end acts on at least one switch for closing it when said finger penetrates into said notch, said switch being mounted in a circuit energizing said electromagnet.

8. The mechanism as claimed in claim 5, comprising a dog mounted for pivoting on a fixed shaft against a spring and which may be locked by two triggers each of which may be unlocked by an overload relay.

9. The mechanism as claimed in claim 8, wherein one of said triggers is the one which also locks said cam, whereas the other is controlled by another overload relay, a mechanical drive being provided between these two triggers.

10. The mechanism as claimed in claim 8, wherein said dog is locked in its travel towards the tripped position by the abutment of a finger which is fast therewith on a flat formed on a cam integral with said shaft.

11. The mechanism as claimed in claim 8, wherein said dog is urged towards its stop position by a heel which is formed on a cam integral with said shaft and which cooperates with a finger integral with said dog.

12. The mechanism as claimed in claim 1, wherein said levers act on a single pusher block controlling a single group of switches.

13. The mechanism as claimed in claim 1, wherein an unlocking cam is mounted on said shaft and acts on said pusher block through a lever.

* * * * *